US007645153B1

(12) United States Patent
McCauley et al.

(10) Patent No.: US 7,645,153 B1
(45) Date of Patent: Jan. 12, 2010

(54) CONNECTOR RETAINER

(75) Inventors: Kathryn M. McCauley, Durand, MI (US); Charles Scott Nelson, Fenton, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 12/143,395

(22) Filed: Jun. 20, 2008

(51) Int. Cl.
*H01R 13/15* (2006.01)

(52) U.S. Cl. ..... 439/260

(58) Field of Classification Search ..... 439/260, 439/274, 275, 589, 913; 174/84 C, 84 R; 204/424, 427
See application file for complete search history.

(56) References Cited

U.S. PATENT DOCUMENTS

| | | | | | |
|---|---|---|---|---|---|
| 2,563,713 | A * | 8/1951 | Frei et al. | 439/598 |
| 4,512,871 | A * | 4/1985 | Kato et al. | 204/429 |
| 4,578,174 | A * | 3/1986 | Kato et al. | 204/429 |
| 5,098,548 | A * | 3/1992 | Duce | 204/424 |
| 5,296,836 | A * | 3/1994 | Saburi et al. | 338/34 |
| 5,602,325 | A * | 2/1997 | McClanahan et al. | 73/23.31 |
| 5,817,920 | A * | 10/1998 | Kuisell et al. | 73/23.31 |
| 5,886,248 | A * | 3/1999 | Paulus et al. | 73/23.31 |
| 5,949,023 | A * | 9/1999 | Weyl | 174/77 R |
| 5,967,816 | A * | 10/1999 | Sampa et al. | 439/190 |
| 6,063,249 | A * | 5/2000 | Duce et al. | 204/424 |
| 6,068,746 | A * | 5/2000 | Kojima et al. | 204/421 |
| 6,085,575 | A * | 7/2000 | Wienand et al. | 73/23.32 |
| 6,231,348 | B1 * | 5/2001 | Mayer et al. | 439/33 |
| 6,527,928 | B1 * | 3/2003 | Watanabe et al. | 204/424 |
| 6,762,365 | B2 * | 7/2004 | Inoue et al. | 174/84 R |
| 6,878,252 | B2 | 4/2005 | Weyl et al. | |
| 6,979,026 | B2 * | 12/2005 | Kasahara et al. | 285/93 |
| 7,064,273 | B1 * | 6/2006 | Kiely | 174/666 |
| 7,104,571 | B2 * | 9/2006 | Inoue et al. | 285/93 |
| 7,399,925 | B2 * | 7/2008 | Yamauchi | 174/74 R |
| 7,461,538 | B2 * | 12/2008 | Matsuo et al. | 73/23.31 |
| 2002/0064988 | A1 * | 5/2002 | Fujita et al. | 439/260 |
| 2004/0124082 | A1 * | 7/2004 | Nakagawa | 204/424 |

(Continued)

OTHER PUBLICATIONS

Co-pending U.S. Appl. No. 12/143,523, filed Jun. 20, 2008; Kathryn McCauley, Charles Scott Nelson; High Temperature Connector.
Co-pending U.S. Appl. No. 12/143,321, filed Jun. 20, 2008; Kathryn McCauley, Charles Scott Nelson; High Temperature Connector Body.

(Continued)

*Primary Examiner*—T C Patel
*Assistant Examiner*—Vladimir Imas
(74) *Attorney, Agent, or Firm*—Thomas N. Twomey

(57) ABSTRACT

A connector body retainer for a high temperature electrical connector used in a high temperature gas sensor retains the ceramic body portions while also permitting their hinged movement. The connector body retainer includes a pair of retainer bands each having a generally u-shaped or c-shaped profile with a base portion and a pair of opposed extending legs, the legs of each band extending toward the other in opposing arrangement to provide the retainer, with each retainer band having an outer surface, an inner surface, a hinge end and an insertion end. The legs of the respective bands which are in opposing arrangement are joined together by a respective pair of outwardly arched hinges proximate the hinge end and will allow the ceramic body portions to hinge open to receive a gas sensor at a relatively low insertion force and hinge closed to provide a relatively higher contact force.

20 Claims, 6 Drawing Sheets

U.S. PATENT DOCUMENTS

| | | | | |
|---|---|---|---|---|
| 2005/0198810 | A1* | 9/2005 | Taguchi et al. | 29/592.1 |
| 2005/0224347 | A1* | 10/2005 | Hahn et al. | 204/424 |
| 2007/0072428 | A1 | 3/2007 | Chilcott | |
| 2008/0099334 | A1* | 5/2008 | Yamauchi | 204/427 |
| 2008/0099335 | A1* | 5/2008 | Yamauchi | 204/427 |

OTHER PUBLICATIONS

Co-pending U.S. Appl. No. 12/143,505, filed Jun. 20, 2008; Kathryn McCauley, Charles Scott Nelson; Gas Sensor.
Co-pending U.S. Appl. No. 12/143,538, filed Jun. 20, 2008; Kathryn McCauley, Charles Scott Nelson; Radial Crimp Seal.

* cited by examiner

CONNECTOR RETAINER

TECHNICAL FIELD

An exemplary embodiment of the present invention relates generally to high temperature electrical connectors and, more particularly, connector retainers used therein.

BACKGROUND OF THE INVENTION

Combustion engines that run on fossil fuels generate exhaust gases. The exhaust gases typically include oxygen as well as various undesirable pollutants. Non-limiting examples of undesirable pollutants include nitrogen oxide gases (NOx), unburned hydrocarbon gases (HC), and carbon monoxide gas (CO). Various industries, including the automotive industry, use exhaust gas sensors to both qualitatively and quantitatively sense and analyze the composition of the exhaust gases for engine control, performance improvement, emission control and other purposes, such as to sense when an exhaust gas content switches from a rich to lean or lean to rich air/fuel ratio. For example, HC emissions can be reduced using sensors that can sense the composition of oxygen gas ($O_2$) in the exhaust gases for alteration and optimization of the air to fuel ratio for combustion.

A conventional high temperature gas sensor typically includes an ionically conductive solid electrolyte material, a porous electrode on the sensor's exterior exposed to the exhaust gases with a porous protective overcoat, a porous electrode on the sensor's interior surface exposed to a known gas partial pressure, an embedded resistance heater and electrical contact pads on the outer surface of the sensor to provide power and signal communication to and from the sensor. An example of a sensor used in automotive applications uses a yttria-stabilized, zirconia-based electrochemical galvanic cell with porous platinum electrodes to detect the relative amounts of oxygen present in an automobile engine's exhaust. When opposite surfaces of this galvanic cell are exposed to different oxygen partial pressures, an electromotive force (emf) is developed between the electrodes on the opposite surfaces of the electrolyte wall, according to the Nernst equation.

Exhaust sensors that include various flat-plate ceramic sensing element configurations formed of various layers of ceramic and electrolyte materials laminated and sintered together with electrical circuit and sensor traces placed between the layers, and embedded resistance heaters and electrical contact pads on the outer surface of the sensor to provide power and signal communication to and from the sensors have become increasingly popular. These flat-plate sensors generally have a sensing portion or end, which is exposed to the exhaust gases, and a reference portion or end, which is shielded from the exhaust gases providing an ambient reference. Gas sensors that employ these elements generally use high temperature electrical connectors for the electrical connection to contact pads on the reference end of the sensor to provide the necessary power and signal communication between a vehicle controller and the gas sensor. These electrical connectors are exposed to the extreme operating temperatures of internal combustion engine exhaust systems, which may include temperatures at the connector of greater than 200° C. and up to about 350° C. Thus, these connectors generally have connector bodies made from high temperature materials, such as ceramics.

These connectors also include electrical terminals which are generally disposed within the ceramic body portions and provide both contact portions to make the necessary electrical contact with the contact pads and termination portion for attachment to wires for communication with the controller. The connectors, including the ceramic body portions and terminals, must be designed so as to receive the ceramic gas sensor with a relatively low insertion force, but to have a relatively higher contact force in operation to ensure the reliability of the communications between the controller and the sensor. One such connector has proposed a clamshell configuration where opposing halves of a ceramic connector body open in a clamshell configuration to receive the gas sensor, whereupon the halves of the sensor are closed to establish electrical contact between electrical terminals disposed on the respective connector halves and the contact pads on the gas sensor. Upon closing the connector halves, a solid metal connector retaining ring is disposed around them to retain the connector body portions and establish the operating contact force between the terminals and the contact pads.

While various high temperature electrical connector configurations have been proposed, there remains a desire for improved high temperature connectors, including those having improved connector body retainers.

SUMMARY OF THE INVENTION

In general terms, this invention provides an improved connector body retainer for a high temperature electrical connector, such as those used in high temperature gas sensors, which will positively retain the ceramic body portions while also permitting their hinged movement. The connector body retainer will allow the ceramic body portions to hinge open to receive a gas sensor at a relatively low insertion force and hinge closed to provide a relatively higher contact force. The connector body retainer may also include inwardly projecting arms which act as spring members to promote positive retention of the ceramic connector bodies. The connector body retainer may further include flex members that act to maintain alignment of the connector bodies. The connector body retainer may further include a spring member that may be used to provide a spring bias to obtain the desired contact force upon hinged closure of the electrical connector.

An exemplary embodiment of the present invention provides a connector body retainer. The connector body retainer includes a pair of retainer bands each having a generally u-shaped or c-shaped profile with a base portion and a pair of opposed extending legs. The legs of each band extend toward the other in opposing arrangement to provide the retainer, each retainer band having an outer surface, an inner surface, a hinge end and an insertion end. The legs of the respective bands which are in opposing arrangement are joined together by a respective pair of outwardly arched hinges proximate the hinge end.

The connector body retainer may include an inwardly extending arm on each retainer band, and may also include at least two inwardly extending arms on each retainer band. The inwardly extending arm, or arms, may be located in the base portion of the retainer.

The connector body retainer may also be configured to include an outwardly extending arm, and may further be configured with an outwardly extending arm having two inwardly extending arms located on opposite sides thereof. The connector body retainer configurations with an outwardly extending arm may have the outwardly extending arm located in the base portion. The connector body retainer configurations with an outwardly extending arm may have the arm shaped in an outwardly-bent bow configuration such that they also have a free end, and the free end may be configured to provide touching contact with an outer surface of a connector body.

The connector body retainer may also be configured such that each retainer band further includes a flex member proximate the insertion end which protrudes toward the other retainer band and a retainer cavity which matingly receives the flex member of the other retainer band. The flex member may be configured to taper inwardly from the insertion end.

The connector body retainer may also include a formed metal sheet having a first joint edge and a second joint edge which are fixed to one another by a joint. The first joint edge may include a protrusion and the second joint edge may include a recess adapted for mating engagement with the protrusion. The joint may include a staked joint having a deformed portion in one of the protrusion or the recess.

Another exemplary embodiment of the present invention provides a connector body retainer that includes a pair of retainer bands formed from a metal sheet each having a generally u-shaped or c-shaped profile with a base portion and a pair of opposed extending legs. The legs of each band extend toward the other in opposing arrangement to provide the retainer, each retainer band having an outer surface, an inner surface, a hinge end and an insertion end. The legs of the respective bands which are in opposing arrangement are joined together by a respective pair of outwardly arched hinges proximate the hinge end, and the metal sheet has a first joint edge and a second joint edge which are fixed to one another by a joint. The connector body retainer also includes an inwardly extending arm disposed on each retainer band which projects inwardly from the inner surface. The connector body retainer further includes an outwardly extending arm disposed on each retainer band which projects outwardly from the outer surface. Still further, the connector body retainer includes a flex member proximate the insertion end which protrudes toward the other retainer band and a retainer cavity which matingly receives the flex member of the other retainer band.

These and other features and advantages of this invention will become more apparent to those skilled in the art from the detailed description of a preferred embodiment. The drawings that accompany the detailed description are described below.

BRIEF DESCRIPTION OF THE DRAWINGS

The following is a brief description of the drawings wherein like elements are numbered alike in the several views.

DETAILED DESCRIPTION OF A PREFERRED EMBODIMENT

An exemplary embodiment of the present invention provides an improved connector body retainer for a high temperature electrical connector suitable for use in a high temperature gas sensor. The connector body retainer provides retainer bands which will positively retain the ceramic body portions while also permitting their hinged movement. The connector body retainer band will allow the ceramic body portions to hinge open to receive a gas sensor at a relatively low insertion force and hinge closed to provide a relatively higher contact force. The connector body retainer bands may also include inwardly projecting arms which act as spring members to promote positive retention of ceramic connector bodies. The connector body retainer bands may further include flex members that act to maintain alignment of the connector bodies. The connector body retainer bands may further include a spring member that may be used to provide a spring bias to obtain the desired contact force upon hinged closure of the electrical connector. A particular advantage of the connector body retainer of the invention is that it may be used to provide a compact high temperature electrical connector, which in turn enables more compact gas sensors, including those having an M12×1.25 thread form, 14 mm wrench flats and an overall length of about 46.5 mm, a smaller lower shield having a diameter of only about 5.3 mm and protruding length of about 10.5 mm and a smaller sensor element having a width of about 2.4 mm, a length of about 27 mm and a thickness of about 0.82 mm. This small overall gas sensor profile provides much more flexibility in the mounting of the sensor, including access to various manifolds, conduits and other mounting points which were previously too small in themselves, or inaccessible due to the larger envelope of free space required to place or attach larger sensors due to the interference constraints associated with other vehicle or engine components. The reduced profile also provides a benefit with regard to material cost savings due to the reduced amounts of material required for most of the sensor components. The smaller thread size also enables mounting the sensors in smaller diameter and smaller length exhaust pipes and other conduits. Further, the smaller cross-section of the lower shield and sensing end of the sensor reduces intrusion into and interference with the exhaust stream. Still further, the smaller gas sensor houses a much smaller flat-plate ceramic sensing element that requires less power for activation (burn-off) of the sensor and a shorter sensor response times, thereby reducing the power load on the electrical systems and improving the responsiveness of the vehicle emission control systems of vehicles which utilize these sensors.

Figure 1:
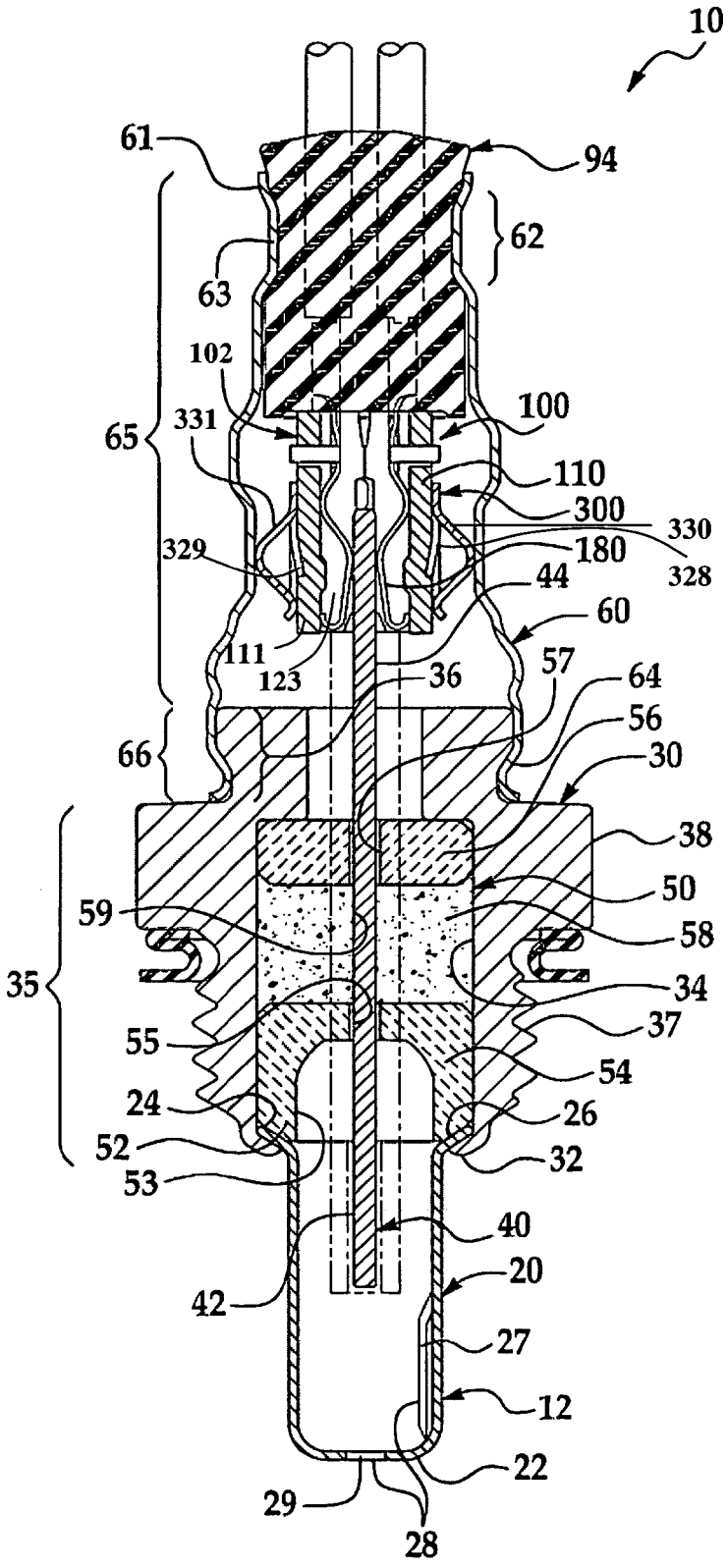
FIG. 1 is a cross-sectional view of an exemplary embodiment of a connector body retainer in a high temperature connector in a high temperature gas sensor according to the invention.

FIG. 1 illustrates a high-temperature gas sensor 10 which is adapted to qualitatively and quantitatively sense various exhaust gases, such as $O_2$, $NO_X$, HC, CO and the like, which incorporates an exemplary embodiment of the connector retainer body of the present invention. An exemplary embodiment of gas sensor 10 includes a generally cylindrical lower shield 20, sensor shell 30, flat-plate ceramic sensor 40, sensor packing 50, upper shield 60 and electrical connector assembly 100. Gas sensor 10 is suitable for exposure in a high temperature exhaust gas stream, including operating temperatures up to about 1000° C. at the sensing end 12 that is located in the exhaust gas stream, such as those found in the exhaust system of an internal combustion engine, including those used in many vehicular applications. Gas sensor 10 may be made in a compact form with an overall length of about 46.5 mm from the lower end of the lower shield to the upper end of the elastomeric seal.

Lower shield 20 is a substantially cylindrical form having a substantially closed end 22 and an open end 24. Open end 24 may include an outwardly extending flange 26 in the form of a straight taper or arcuate flair or other suitable flange form. Lower shield 20 is preferably formed of a metal that is adapted for high-temperature performance including resistance to high temperature oxidation and corrosion, particularly as found in high temperature exhaust gases and corrosive combustion exhaust byproducts associated with the exhaust stream of an internal combustion engine. Suitable metals include various ferrous alloys, such as stainless steels, including high chrome stainless steel, high nickel stainless steel, as well as various Fe-base, Ni-base, and Cr-base superalloys. The various ferrous and other alloys described above are generally indicative of a wide number of metal alloys that are suitable for use as lower shield 20. In an exemplary embodiment, lower shield 20 may be formed from type 310 stainless steel (UNS 31008) and may have an outer diameter of about 5.3 mm and an exposed length (i.e., below the deformed shoulder 32) of about 10.5 mm. Lower shield 20 abuts a lower end 62 of packing 50 and applies a compressive force thereto by the operation of deformed shoulder 32 at a lower end of shell 30. Deformed shoulder 32 presses against the outer surface of outwardly extending flange 26 and acts to retain both lower shield 20 and packing 50 within central bore 34 of shell 30. Lower shield 20 also includes one or more orifice 28 in the form of a bore 29, or louver 27 formed by piercing and inwardly bending the sidewall. Bore 29 may have any suitable shape, including various cylindrical, elliptical and slot-like shapes. Orifices 28 permit exhaust gases to enter the interior of lower shield 20 and come into contact with the lower or sensing end 42 of sensor 40 during operation of sensor 10, while at the same time, lower shield 20 provides a physical shield for sensor 40 against damage from the full fluid force of the exhaust gas stream, or from damage that may be caused by various mechanical or thermal stresses that result during installation or operation of sensor 10. While deformed shoulder 32 is illustrated for attachment of lower shield 20 in compressive engagement with packing 50, it will be appreciated that other means of attaching lower shield 20 to shell 30 while maintaining packing 50 in compressed engagement are possible, including various forms of weld joints, brazed joints and other attachment means and mechanisms.

In addition to deformed shoulder 32 and central bore 34, sensor shell 30 may be described generally as having an attachment portion 35 and a sealing portion 36. Attachment portion 35 may include a threaded form 37 which is adapted for threaded insertion and attachment into a component of the exhaust system of an internal combustion engine, such as an exhaust manifold or other exhaust system component, and tool attachment features 38, such as various forms of wrench flats (e.g. hex-shaped, double-hex and other wrench flat configurations). In an exemplary embodiment, shell 30 may have a thread form of M12×1.25 and a 14 mm hex wrench flats and be formed from Ni-plated steel. Shell 30 may be made from any material suitable for high-temperature exposure, including installation stresses associated with the threaded connection, mechanical stresses associated with usage of the device including various bending moments, thermal stresses and the like. Shell 30 will preferably be formed from a ferrous material, such as various grades of steel, including various plated or coated steels, such as those having various pure nickel or nickel alloy plating or coatings; however, the use of other metal alloys is also possible. While one embodiment of shell 30 is described herein, it will be appreciated by one of ordinary skill that many other forms of shell 30 may be used in conjunction with the present invention.

Referring again to FIG. 1, packing 50 is made up of a lower support disk 54, an upper support disk 56 and sealing member 58. Lower support disk 54 has a central slot 55 that is adapted to receive sensor 40 in closely spaced relation between slot 55 and the outer surface of sensor 40 proximate to slot 55. Generally, a substantially rectangular slot configuration provides closely spaced relation between lower support disk 54 and the outer surface of sensor 40. Lower support disk 54 may have a relieved portion 53 to provide spacing from sensor 40, and increase the exposure of the surface of sensor 40 to the exhaust gases that enter the interior of lower shield 20 during operation of sensor 10 in conjunction with operation of the associated internal combustion engine. Lower support disk 54 will generally be sized for slip-fit engagement with central bore 34 such that lower support disk 54 may be inserted into central bore 34 during assembly and yet have a minimal gap therebetween so as to reduce the tendency for leakage of exhaust gas between the outer surface of lower support disk 54 during operation of the sensor 10. The lower end 52 of the lower support disk 54 and central bore 34 may be tapered downwardly and inwardly or otherwise adapted for mating engagement with flange 26. Lower support disk 54 will generally be made from an electrically and thermally insulating, high-temperature ceramic material. Any suitable high-temperature ceramic material may be utilized, including various oxide, nitride or carbide ceramics or combinations thereof. Any suitable material may be utilized which is compatible with the function of sensor 40 and the operation of sealing member 58 in the high temperature operating environment of sensor 10.

The upper end of lower support disk 54 compressively engages sealing member 58. Sealing member 58 is preferably a compressed insulating powder, such as a talc disk. The compressed powder material of sealing member 58 is both electrically and thermally insulating. Sealing member 58 also has a central slot 59 that is adapted to receive sensor 40 in closely spaced relation between slot 59 and the outer surface of sensor 40 proximate to slot 59, particularly during installation of sealing member 58 over sensor 40. Upon installation of packing 50, including the compressive loading described herein, sealing member 58 is in compressed sealing engagement with the sensor 40 on the interior thereof, and shell 30 on the exterior thereof. Upon compressive installation of packing 50, sealing member 58 is operative to prevent passage of hot exhaust gases, particularly those received through orifices 28, from passing between the packing 50 and central bore 34 or along the surface of sensor 40 to an upper end 44 thereof.

Upper support disk 56 is in pressing engagement with sealing member 58 and is adapted to retain sealing member 58, such as by preventing it from being extruded through an upper portion of central bore 34. Upper support disk 56 also includes a central slot 57 that is adapted to receive sensor 40 in a similar manner as central slot 55 of lower support disk 54. Upper support disk 56 is likewise adapted for slip-fit engagement with central bore 34 in the manner described for lower support disk 54. Upper support disk 56 may be made from any suitable high temperature material, including ceramics or other materials identical to those used for lower support disk 54. However, upper support disk may also be made from a separate material, including a different ceramic material than that of lower support disk 54. Since upper support disk 56 is located further from the exhaust gas stream than lower support disk 54 and generally is exposed to somewhat lower temperatures than lower support disk 54, it may be desirable in some applications to make upper support disk 56 from a different material than that of lower support disk 54. While one configuration of packing 50 has been described, it will be appreciated that many other forms of packing 50 may be used in conjunction with the present invention.

High temperature gas sensor 40 may be of any suitable internal and external configuration and construction. Gas sensor 40, is preferably a flat-plate sensor having the shape of a rectangular plate or prism. Gas sensor 40 will typically include an ionically conductive solid electrolyte material, a porous electrode on the sensors exterior which is exposed to the exhaust gases, a porous protective overcoat, a porous electrode on the interior of the sensor which is adapted for exposure to a known gas partial pressure, an embedded resistance heater and various electrical contact pads on the outer surface of the sensor to provide the necessary circuit paths for power and signal communication to and from the sensor. Depending on the arrangement of the various elements described above, gas sensor may be configured to quantitatively, qualitatively, or both, sense various constituents of the exhaust gas, including $O_2$, $NO_X$, HC and CO. For automotive applications, an example of a suitable construction of sensor 40 would include a yttria-stabilized, zirconia-based electrochemical galvanic cell with porous platinum electrodes to detect the relative amounts of oxygen present in engine exhaust. When opposite surfaces of such a galvanic cell located at sensing end 42 and reference end 44 are exposed to different oxygen partial pressures, an electromotive force (EMF) is developed between electrodes located at these ends on the opposite surfaces of the electrolyte wall according to the Nernst Equation. In an exemplary embodiment, gas sensor may have the shape of a rectangular prism having a width of about 2.4 mm, a length of about 27 mm and a width of about 0.82 mm. While an exemplary embodiment of gas sensor 40 is described above, various configurations of gas sensor 40 are contemplated for use in conjunction with the exemplary embodiment of the invention, including gas sensors 40 which are adapted for sensing other exhaust gas constituents, and further including gas sensors having other dimensions and flat-plate configurations.

Figure 2:
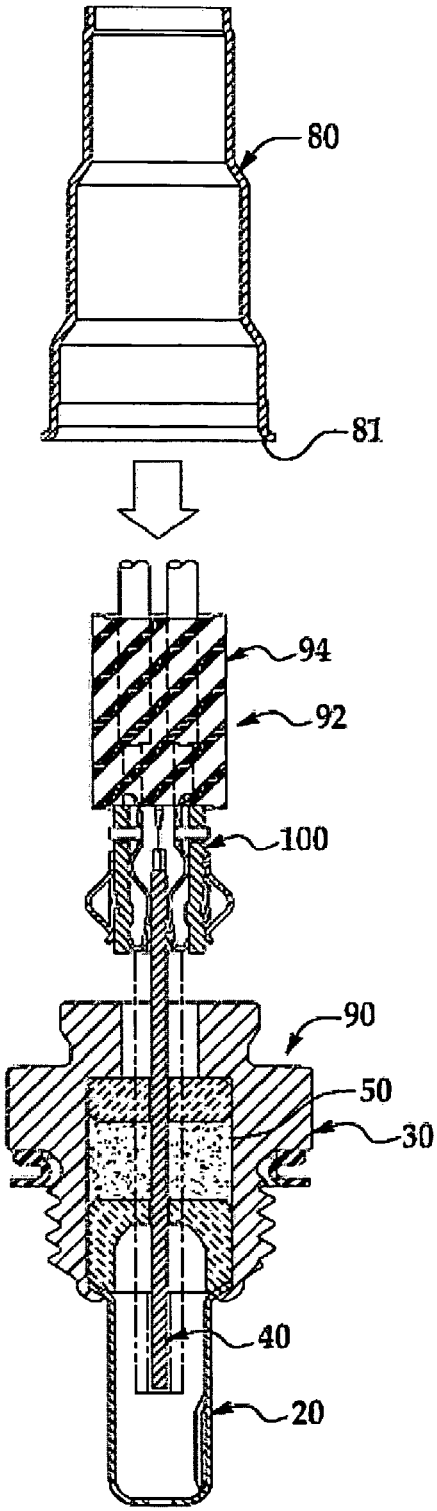
FIG. 2 is a schematic cross-sectional view illustrating the insertion of a precursor upper shield onto a sensor-connector subassembly.

Referring to FIG. 2, in an exemplary embodiment, the lower shield 20, sensor shell 30, gas sensor 40 and packing 50 may be assembled in the manner described herein to form a sensor subassembly 90. The electrical connector 100 is inserted onto the sensor subassembly 90 by insertion of the upper or reference end 44 of sensor 40 into a sensor pocket on the insertion end of electrical connector 100, as shown in FIG. 2, to form a sensor/connector subassembly 92. Electrical connector 100 hinges open to receive sensor 40. It is preferred that sensor 40 and electrical connector 100 be configured so that upon insertion of the sensor subassembly 90, sufficient power and signal communication are established between the conductive terminals 180 of the electrical connector 100 and the electrical contacts (not shown) of sensor 40 to pretest the electrical connections between them. Once the necessary electrical connections are assured, the assembly of gas sensor 10 is completed by the addition of upper shield of 60 which is formed from the precursor upper shield 80, as shown in FIG. 2.

Figure 6:
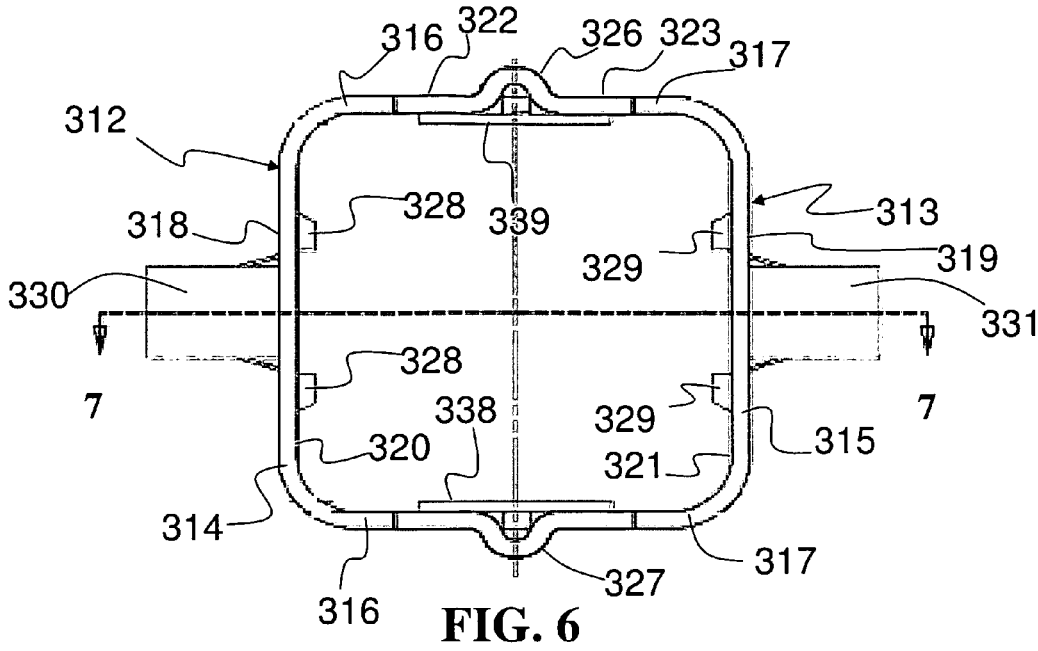
FIG. 6 is a top view of the connector body retainer of FIG. 4.
Figure 7:
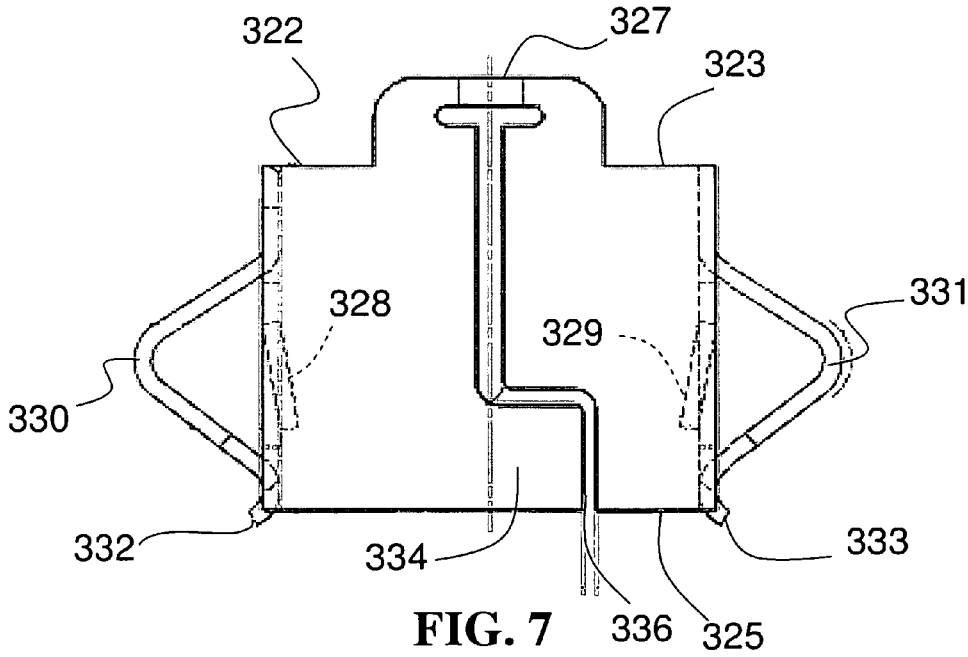
FIG. 7 is a front view of the connector body retainer of FIG. 4.
Figure 8:
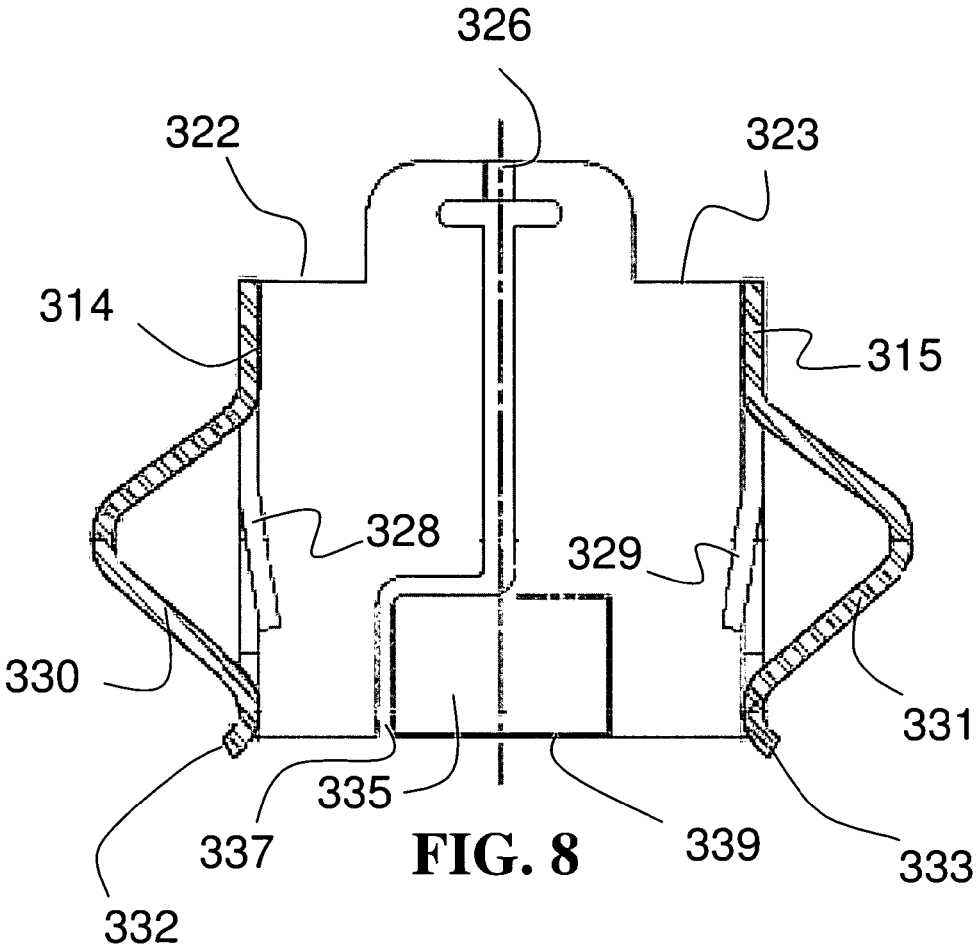
FIG. 8 is a cross sectional view of the connector body retainer of FIG. 6 taken along Section 8-8.

Referring again to FIG. 2, the precursor upper shield 80 is installed over the sensor-connector subassembly 92 (FIG. 6) to the position shown in FIG. 7 so that the upper end 81 of precursor upper shield is located proximate, preferably in touching contact with, an upper shoulder of tool attachment feature 38. Precursor upper shield 80 is preferably formed of a metal that is adapted for high-temperature performance including resistance to high temperature oxidation and corrosion, particularly as found in high temperature exhaust gases and corrosive combustion exhaust byproducts associated with the exhaust stream of an internal combustion engine. Suitable metals include various ferrous alloys, such as stainless steels, including high chrome stainless steel, high nickel stainless steel, as well as various Fe-base, Ni-base, and Cr-base superalloys. The various ferrous and other alloys described above are generally indicative of a wide number of metal alloys that are suitable for use as precursor upper shield 80. In an exemplary embodiment, precursor upper shield 80 may be formed from type 304 stainless steel (UNS 30400). In an exemplary embodiment, precursor upper shield 80 may have an overall length of about 22 mm and an inner diameter that varies in three cylindrical sections of decreasing diameter from top to bottom of about 7 mm to about 11 mm. The precursor upper shield 80 is deformed, such as by crimping, to form upper shield 60.

Upper shield 60 is formed from a precursor upper shield 80, such as that shown in FIG. 2. A gas-tight upper sealed joint 62 is formed in sensor 10 when precursor upper shield 80 as shown in FIG. 2 is plastically deformed into upper shield 60 having the shape shown in FIG. 1. This deformation may include a plurality of crimps formed along the length of precursor upper shield 80. A gas-tight upper sealed joint 62 is formed when precursor upper shield 80 as shown in FIG. 2 is crimped and plastically deformed into upper shield 60 having the shape shown in FIG. 1. Crimp 63 provides pressing engagement between an inner surface of the upper end of upper shield 60 and an outer surface of elastomeric sealing member 94. Crimp 63 deforms precursor upper shield 80 at an upper end 82 thereof sufficiently to provide pressing engagement between upper shield 60 and elastomeric sealing member 94, including the deformation of elastomeric sealing member 94, thereby forming upper sealed joint 62. While shown as a single radial crimp 63 in FIG. 1, upper sealed joint 62 may also be formed by a plurality of radial crimps of the type described herein. Upper shield 60 has a shell portion 66 and a connector portion 65 that extends upwardly and away from shell 30 and generally includes the portions of upper shield 60 other than shell portion 66.

Sensor 10 also includes a lower sealed joint 64 between sealing portion 36 of shell 30 and the shell portion 66 of upper shield 60. Referring now to FIG. 1, lower sealed joint 64 is a gas-tight sealed joint formed between the outer surface of sealing portion 36 of shell 30 and the inner surface of the shell portion 66 of upper shield 60. Lower sealed joint 64 is formed when precursor upper shield 80 is crimped and plastically deformed into upper shield 60 having the shape shown in FIG. 1.

Referring again to FIG. 1, electrical connector 100 is adapted to provide an electrical connection for power and signal communication between sensor 40 and a device that is adapted to receive such communications, such as an engine or other controller while at the same time providing the required electrical isolation between the various circuit paths associated with the required power and signal communication. Electrical connector 100 is in spring-biased engagement within an upper end 61 of upper shield 60 through outwardly extending spring arms 320 associated with the connector body retainer 300. Electrical connector 100 is a clamshell configuration of a pair of ceramic connector body portions 110,111 that are housed and retained in connector body retainer 300. The spring-bias closes the clamshell and ensures a sufficient contact pressure between the conductive terminals 180 of the connector and electrical contacts (not shown) located on the upper end 44 of sensor 40 to provide a low resistance electrical connection sufficient for signal and power communication between sensor 40 and a device, such as a controller, which is adapted to receive the signal.

Figure 3:
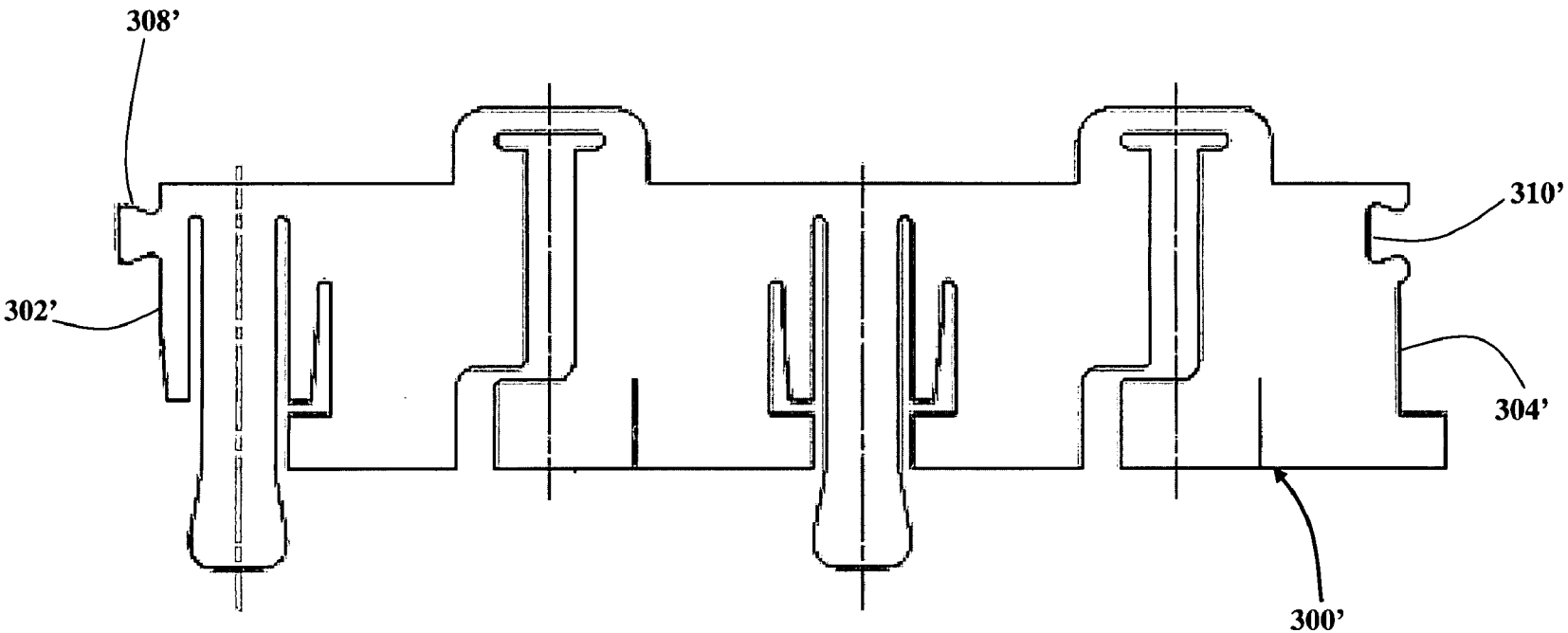
FIG. 3 is a top view of a precursor connector body retainer.
Figure 4:
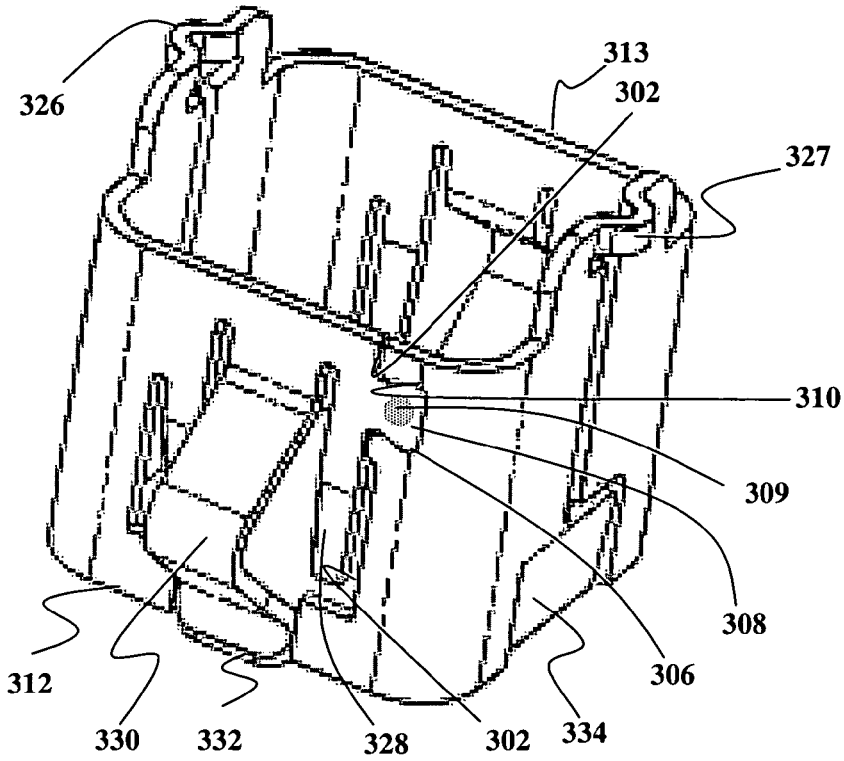
FIG. 4 is a top perspective view of an exemplary embodiment of a connector body retainer of the present invention.
Figure 5:
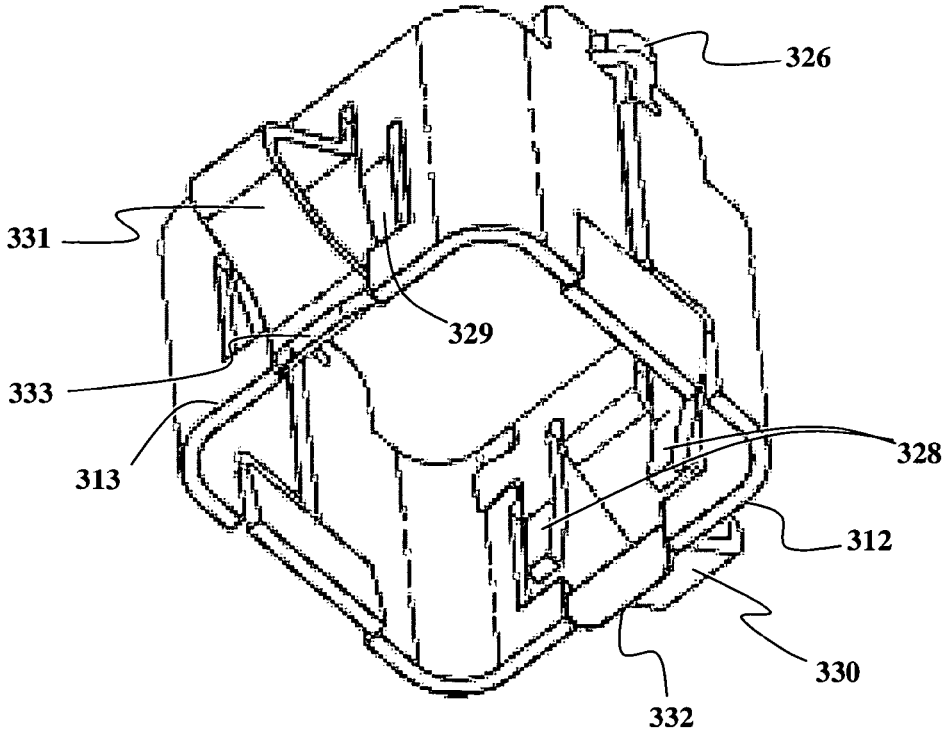
FIG. 5 a bottom perspective view of the connector body retainer of FIG. 4.

Referring to FIGS. 4-8, an exemplary embodiment of the present invention provides a connector body retainer 300. The connector body retainer 300 and the features thereof described herein may be formed from a precursor connector body retainer 300', as shown in FIG. 3. The precursor connector body retainer 300' may be formed by stamping the features shown from a metal sheet using a suitable die. Any suitable metal sheet may be used, but those having particularly good high temperature mechanical properties, such as tensile strength and creep resistance, oxidation resistance and corrosion resistance are particularly desirable. Suitable metals include various ferrous alloys, such as stainless steels, including high chrome stainless steel, high nickel stainless steel, as well as various Fe-base, Ni-base, and Cr-base superalloys. The various ferrous and other alloys described above are generally indicative of a wide number of metal alloys that are suitable for use as precursor connector body retainer 300'. In an exemplary embodiment, precursor connector body retainer 300' may be formed from a sheet of type 304 stainless steel (UNS 30400) having a thickness of about 0.2 mm. The precursor connector body retainer 300' may be formed using any suitable method, such as forming in a progressive die, into the connector body retainer 300 having the features described herein, as illustrated in FIGS. 4-8. The precursor connector body retainer 300' has a precursor first joint edge 302' and a precursor second joint edge 304' that are fixed to one another by a joint 306 during the process of forming connector body retainer 300 (FIG. 4). The precursor first joint edge 302' has a protrusion 308' and the precursor second joint edge 304' has a recess 310' adapted for mating engagement with the protrusion 308'. The joint 306 may be any suitable joint and employ any suitable joining method, including various joints made by mechanical deformation, welding, brazing and the like. In an exemplary embodiment, joint 306 is a staked joint having a deformed portion 309 in one of the protrusion 308 or the recess 310 to fix the protrusion 308 in the recess 310. While the protrusion 308 and recess 310 shown in FIG. 4 interlock in of the manner of the locking tabs of a jigsaw puzzle, and then are fixed by staking, any suitable mating protrusion and recess configuration may be used.

The connector body retainer 300 includes a pair of retainer bands 312,313, each having a generally u-shaped or c-shaped profile with respective base portions 314,315 and respective pairs of opposed extending legs 316,317. The profile of the connector body retainer 300 is generally selected for mating engagement with the ceramic connector body 102; including the ceramic connector body portions 110,111 (see FIGS. 1 and 2). A generally u-shaped profile as shown in FIGS. 4-8 may be used with ceramic connector body portions that form a generally rectangular prism-shaped ceramic connector body 102 having a generally rectangular cross-sectional profile, while a generally c-shaped profile may be used with ceramic connector body portions 110,111 that form a generally cylindrical ceramic connector body 102 (not shown) having a generally circular cross-sectional profile.

The opposed outwardly extending legs 316,317 of each connector body retainer band 312,313 extend toward the other in opposing arrangement to provide the connector body retainer 300. Retainer bands 312,313 have respective an outer surfaces 318,319; inner surfaces 320,321; hinge ends 322,323 and insertion ends 324,325. The legs 316,317 of the respective retainer bands 312,313 which are in opposing arrangement are joined together by a respective pair of outwardly arched hinges 326,327 proximate the hinge end that join retainer bands 312,313. Outwardly arched hinges 326,327 are operative as spring members upon insertion of connector body portions 110,111 and permit the connector body retainer 300 to hinge open and closed in conjunction with the insertion of the gas sensor 40. The hinges, as spring members, may also be used to assist in the retention of connector body portions 110,111 if, upon insertion, they are sized together with the hinge ends 322,323 of the connector body retainer so as to create an interference between them upon insertion of the connector body portions 110,111 into connector body retainer 300. Hinges 326,327 may be designed and sized with respect to their length, width, radius of curvature, and thickness, together with the resultant mechanical properties of the material used upon deformation used to form the hinge, to obtain the desired characteristics as spring members. The retainer bands 312,313 may be formed as substantially identical, excepting the joint ends, bands in the opposing configuration described, or the bands may be different from one another and include the various elements described herein in different combinations or configurations.

Referring to FIGS. 1-8, the retainer bands 312,313 may also include respective inwardly extending arms 328,329. In an exemplary embodiment, as shown in FIGS. 4-8, the respective retainer bands 312,313 each include two inwardly extending arms 328,329. The inwardly extending arms 328,329 are operative to capture the ceramic body portions 110,111. The inwardly extending arms 328,329 flex elastically outwardly during the insertion of the ceramic body portions 110,111, and then spring back inwardly into respective pockets formed in the ceramic body portions 110,111 to capture them in the respective retainer bands 312,313, and thus within connector body retainer 300. The inwardly extending arms 328,329 may be located in the base portion of the respective retainer bands 312,313 as shown in FIGS. 4-8; however, they may also be located in the respective legs 316,317 if the respective connector body portion 110,111 have correspondingly located pocket, or in various combinations of the respective base portions and legs. The inwardly extending arms 328,329 are preferably formed as flat precursor inwardly extending arms 328',329' and plastically deformed during the process of transforming precursor connector body retainer 300' into connector body retainer 300; however, attachment of separate inwardly extending arms 328,329 is not precluded. The inwardly extending arms 328,329 may have the tapered inwardly extending profile shown in FIGS. 4-8 or other suitable inwardly extending profiles.

Referring to FIGS. 1-8, the retainer bands 312,313 may also include respective outwardly extending arms 330,331. In an exemplary embodiment, as shown in FIGS. 4-8, the respective retainer bands 312,313 each include one outwardly extending arm 330,331; however, the bands may include more than one outwardly extending arm. The outwardly extending arms 330,331 are operative to capture the ceramic body portions 110,111. The outwardly extending arms 330,331 flex inwardly, either elastically, plastically or a combination thereof, during the crimping of precursor inner shield 80 to form inner shield 60 as shown in FIGS. 1 and 2. Outwardly extending arms 330,331 act as resilient spring members to apply a closing force respectively to ceramic body portions 110,111 and connector body retainer bands 312,313 and establish the desired contact force between the conductive terminals of the connector and contact pads of the gas sensor. In an exemplary embodiment, the outwardly extending arms 330,331 have an outwardly-bent bow shape and respective free ends 332,333. The free ends 332,333 are adapted for disposition in contact with the outer surfaces of the respective ceramic body portions 110,111 and may apply the closure for directly to them, as well as through the respective retainer bands 312,313. The outwardly extending arms 330,331 may be located in the base portion of the respective retainer bands 312,313 as shown in FIGS. 4-8; however, they may also be located in the respective legs 316,317, or in various combinations of the respective base portions and legs. The outwardly extending arms 330,331 are preferably formed as flat precursor outwardly extending arms 330',331' and plastically deformed during the process of transforming precursor connector body retainer 300' into connector body retainer 300; however, attachment of separate outwardly extending arms 330,331 is not precluded. The inwardly extending arms 328, 329 may have the bow-shaped outwardly extending profile shown in FIGS. 4-8 or other suitable outwardly extending profiles.

Referring to FIGS. 1-8, each of the retainer bands 312,313 may also include respective flex members 334,335 proximate the respective insertion ends 324,325 which protrude toward the other retainer band and a retainer cavity 336,337 which matingly receives the flex member of the other retainer band. In an exemplary embodiment, as shown in FIGS. 4-8, the respective retainer bands 312,313 each include respective flex members 334,335. The flex members 334,335 are operative to capture and provide alignment of the side walls of opposing ceramic body portions 111,110 upon hinged closure of the electrical connector 100. The retainer cavities 336,337 are sized to permit closure of electrical connector 100 and provide an opening sufficient to house flex members 334,335. The flex members 334,335 may be formed so as to extend or taper inwardly from the insertion end to further enhance the function described above by providing innermost edges 338, 339 to capture the opposing connector body portions 111,110 rather than the inner surface of flex members 334,335. The flex members 334,335 are located in the respective legs 316, 317 as shown in FIGS. 4-8. The flex members 334,335 are preferably formed as flat precursor flex members 334',335' and plastically deformed during the process of transforming precursor connector body retainer 300' into connector body retainer 300; however, attachment of separate flex members 334,335 is not precluded. The flex members 334,335 may have the tapered inwardly extending profile shown in FIGS. 4-8 or other suitable inwardly extending profiles.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

We claim:

1. A connector body retainer, comprising:

a pair of retainer bands each having a generally u-shaped or c-shaped profile with a base portion and a pair of opposed extending legs, the legs of each band extending from the respective base portion toward the other in opposing arrangement to provide the retainer, each retainer band having an outer surface, an inner surface, a hinge end and an insertion end, the legs of the respective bands which are in opposing arrangement are joined together by a respective pair of outwardly arched hinges proximate the hinge end.

2. The connector retainer of claim 1, wherein each retainer band further comprises an inwardly extending arm.

3. The connector retainer of claim 2, wherein the inwardly extending arm is located in the base portion.

4. The connector retainer of claim 2, wherein the inwardly extending arm comprises at least two inwardly extending arms on each retainer band.

5. The connector retainer of claim 4, wherein each retainer band further comprises a single outwardly extending arm and has two inwardly extending arms located on opposite sides thereof.

6. The connector retainer of claim 1, wherein each retainer band further comprises an outwardly extending arm.

7. The connector retainer of claim 6, wherein the outwardly extending arm is located in the base portion.

8. The connector retainer of claim 7, wherein each of the outwardly extending arms has an outwardly-bent bow shape and a free end.

9. The connector retainer of claim 8, wherein the free end is adapted for disposition in contact with an outer surface of a connector body.

10. The connector retainer of claim 1, wherein each retainer band further comprises a flex member proximate the insertion end which protrudes toward the other retainer band and a retainer cavity which matingly receives the flex member of the other retainer band.

11. The connector retainer of claim 10, wherein the flex member tapers inwardly from the insertion end.

12. The connector retainer of claim 1, wherein the retainer further comprises a formed metal sheet having a first joint edge and a second joint edge which are fixed to one another by a joint.

13. The connector retainer of claim 12, wherein the first joint edge has a protrusion and the second joint edge has a recess adapted for mating engagement with the protrusion.

14. The connector retainer of claim 13, wherein the joint is a staked joint having a deformed portion in one of the protrusion or the recess.

15. A connector body retainer, comprising:

a pair of retainer bands formed from a metal sheet each having a generally u-shaped or c-shaped profile with a base portion and a pair of opposed extending legs, the legs of each band extending toward the other in opposing arrangement to provide the retainer, each retainer band having an outer surface, an inner surface, a hinge end and an insertion end, the legs of the respective bands which are in opposing arrangement are joined together by a respective pair of outwardly arched hinges proximate the hinge end, and the metal sheet has a first joint edge and a second joint edge which are fixed to one another by a joint;

an inwardly extending arm disposed on each retainer band which projects inwardly from the inner surface;

an outwardly extending arm disposed on each retainer band which projects outwardly from the outer surface; and a flex member proximate the insertion end which protrudes toward the other retainer band and a retainer cavity which matingly receives the flex member of the other retainer band.

16. The connector retainer of claim 15, wherein the inwardly extending arm comprises at least two inwardly extending arms on each retainer band.

17. The connector retainer of claim 16, wherein the two inwardly extending arms are located on opposite sides of the outwardly extending arm.

18. The connector retainer of claim 17, wherein the outwardly extending arm and the inwardly extending arms are located in the base portion.

19. The connector retainer of claim 15, wherein the metal sheet comprises a formable Fe-base, Cr-base or Ni-base alloy having resistance to high temperature oxidation and corrosion.

20. The connector retainer of claim 15, wherein the metal sheet comprises a formable stainless steel.

* * * * *